US006655355B2

(12) United States Patent
Kropp et al.

(10) Patent No.: US 6,655,355 B2
(45) Date of Patent: Dec. 2, 2003

(54) FUEL INJECTION SYSTEM

(75) Inventors: Martin Kropp, Tamm (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 27 days.

(21) Appl. No.: 10/028,798

(22) Filed: Dec. 28, 2001

(65) Prior Publication Data

US 2002/0088436 A1 Jul. 11, 2002

(30) Foreign Application Priority Data

Dec. 28, 2000 (DE) ..... 100 65 103

(51) Int. Cl.[7] ..... F02M 37/04
(52) U.S. Cl. ..... 123/467; 239/96
(58) Field of Search ..... 123/467, 496; 239/88–96

(56) References Cited

U.S. PATENT DOCUMENTS

| | | | | | |
|---|---|---|---|---|---|
| 4,475,515 | A | * | 10/1984 | Mowbray | 123/467 |
| 5,522,364 | A | * | 6/1996 | Knight et al. | 123/467 |
| 5,626,119 | A | * | 5/1997 | Timms | 123/467 |
| 5,664,545 | A | * | 9/1997 | Kato et al. | 123/496 |
| 5,711,279 | A | * | 1/1998 | Green et al. | 123/406 |
| 5,893,350 | A | * | 4/1999 | Timms | 123/467 |
| 6,367,453 | B1 | * | 4/2002 | Igashira et al. | 123/467 |

* cited by examiner

*Primary Examiner*—Thomas N. Moulis
(74) *Attorney, Agent, or Firm*—Ronald E. Greigg

(57) ABSTRACT

In a pressure-controlled fuel injection system, a nozzle needle is subjected to pressure in the closing direction by a nozzle spring. A nozzle chamber for opening the nozzle needle is connectable to a pressure reservoir via a pressure line. A hydraulic device is embodied to reinforce the closing performance of the nozzle needle. As a result, a faster closing performance of the nozzle needle is achieved.

10 Claims, 6 Drawing Sheets

FUEL INJECTION SYSTEM

BACKGROUND OF THE INVENTION

1. Field of the Invention

The invention relates to a fuel injection system for use in internal combustion engines.

2. Description of the Prior Art

For the sake of better comprehension of the description and claims, several terms will first be explained: The fuel injection system of the invention is embodied as pressure-controlled. Within the scope of the invention, a pressure-controlled fuel injection system is understood to mean that by means of the fuel pressure prevailing in the nozzle chamber of an injection nozzle, a nozzle needle is moved counter to the action of a closing force (spring), so that the injection opening is uncovered for an injection of the fuel out of the nozzle chamber into the cylinder. The pressure at which fuel emerges from the nozzle chamber into a cylinder of an internal combustion engine is called the injection pressure, while the term system pressure is understood to mean the pressure at which fuel is available or is kept on hand inside the fuel injection system. Fuel metering means furnishing a defined fuel quantity for injection. The term leakage is understood to be a quantity of fuel that occurs in operation of the fuel injection (such as a reference leakage or diversion quantity) that is not used for the injection and is returned to the fuel tank. The pressure level of this leakage can have a standing pressure, and the fuel is then depressurized to the pressure level of the fuel tank.

In common rail systems, the injection pressure can be adapted to both load and rpm. To reduce noise, a preinjection is often performed. To reduce emissions, a pressure-controlled injection is known to be favorable.

In pressure-controlled systems, a triangular injection course results in the main injection. The nozzle needle closes in response to the drop in pressure in the nozzle chamber. It has been demonstrated that a fast closure (rapid spill) of the nozzle needle is advantageous. This rapid closure can be attained in pressure-controlled fuel injection systems by means of a fast relief of the nozzle chamber. However, the pressure reduction should not proceed so fast that the injection pressure is already reduced while the nozzle needle is still open because of its inertia. That would cause a blowback of combustion gases into the nozzle chamber. By the reinforcement of the needle closure, the relief of the nozzle chamber can proceed more slowly, so that cavitation damage caused by overly rapid relief of the nozzle chamber is avoided.

OBJECT AND SUMMARY OF THE INVENTION

The hydraulic reinforcement of the closing performance causes a fast pressure reduction in the nozzle chamber and thus faster closure of the nozzle needle. The closure, hydraulically reinforced according to the invention, of the pressure-controlled nozzle needle can also be employed for fuel injection systems with a pressure booster, for the sake of improved pressure reduction and refilling. It is advantageous to place the relief valve as close as possible to the nozzle chamber. Another advantage in terms of the closing performance is attained by having the diversion valve communicate not directly with the leakage line but rather via the spring chamber of the injection nozzle. To optimize the relief performance, a throttle can additionally be disposed at the outlet of the nozzle chamber. One additional valve for performing the hydraulically reinforced closure of the nozzle needle can be dispensed with, if for that purpose the diversion flow from the metering valve is used for the fuel injection.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 6:
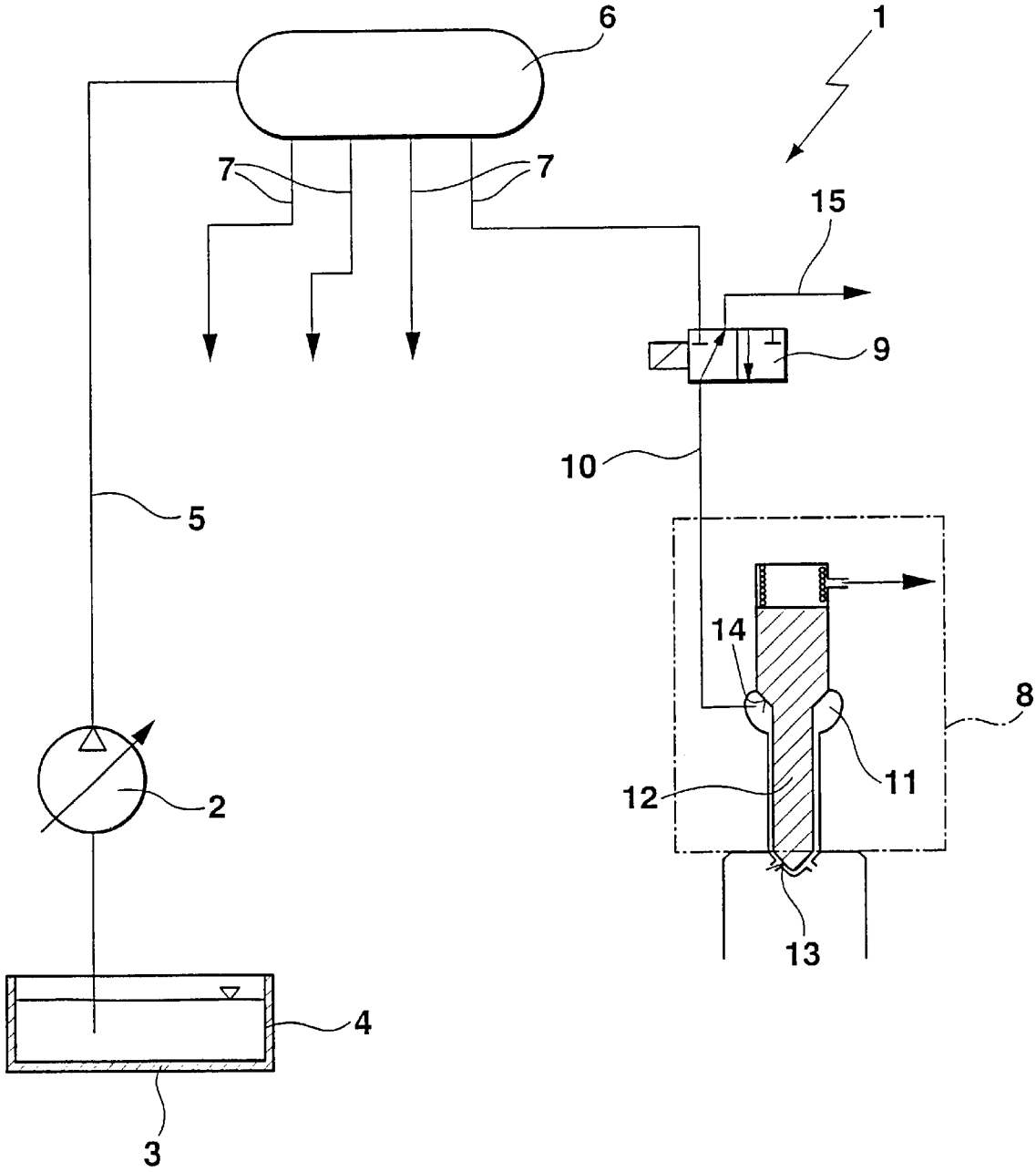
FIG. 6 illustrates the principle of a pressure-controlled fuel injection system in accordance with the prior art.

In the prior art pressure-controlled fuel injection system 1 shown in FIG. 6, a quantity-controlled fuel pump 2 pumps fuel 3 from a tank 4 via a supply line 5 into a central pressure reservoir 6 (or common rail), from which a plurality of pressure lines 7, corresponding to the number of individual cylinders, lead away to the individual injection nozzles 8, protruding into the combustion chamber of the internal combustion engine to be supplied. Only one of the injection nozzles 8 is shown in detail in FIG. 6. With the aid of the fuel pump 2, a system pressure is generated and stored in the pressure reservoir 6, at a pressure of from 300 to approximately 1800 bar.

Located in the region of the pressure reservoir 6 are metering valves 9, which are embodied as 3/2-way magnet valves. With the aid of the metering valve 9, the injection for each cylinder is achieved under pressure control. A pressure line 10 connects the pressure reservoir 6 to a nozzle chamber 11. The injection takes place with the aid of a nozzle needle 12, which is axially displaceable in a guide bore, and which has a conical valve sealing face 13 on one end with which it cooperates with a valve seat face on the housing of the injection nozzle 8. Injection openings are provided on the valve seat face of the housing. Inside the nozzle chamber 11, a pressure face 14 pointing in the opening direction of the nozzle needle 12 is subjected to the pressure prevailing there, which is delivered to the nozzle chamber 11 via the pressure line 10.

After the opening of the metering valve 9, a high-pressure fuel wave travels in the pressure line 10 to the nozzle chamber 11. The nozzle needle 12 is lifted from the valve seat face counter to a restoring force, and the injection event can begin.

Upon termination of the injection and a closed communication between the nozzle chamber and pressure reservoir 6, the pressure in the nozzle chamber 11 drops, because the pressure line 10 is connected to a leakage line 15. The nozzle needle 12 begins its closing process.

Figure 1:
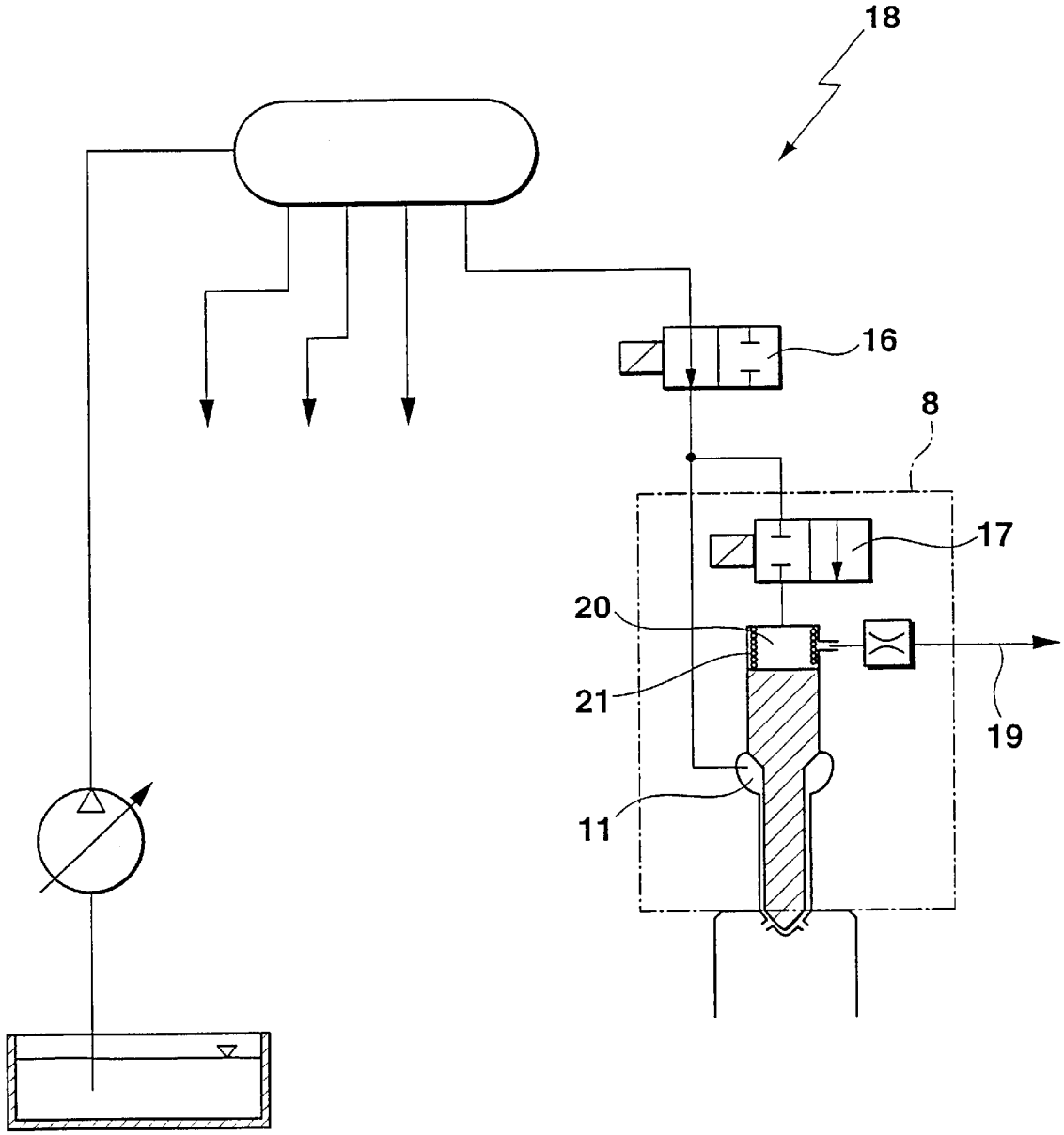
FIG. 1 schematically illustrates a first fuel injection system according to the teaching of the invention.

In accordance with the invention, and in contrast to FIG. 6, FIG. 1 shows that instead of the 3/2-way valve 8, two 2/2-way valves 16 and 17 are used in a fuel injection system 18. The 2/2-way valve 16 takes on the metering of the high pressure from the pressure reservoir, while the 2/2-way valve 17 takes on the relief or diversion task. It is advantageous to place the relief valve 17 near the nozzle chamber 11. The metering valve 16 can likewise be mounted in the nozzle holder. Both valves 16 and 17 can also be controlled by an actuator, for the sake of reducing effort and expense. Disposing the metering valve on the pressure reservoir 6 additionally enables an elevation in the injection pressure by utilizing the line oscillations. A decisive advantage with regard to the closing performance of the nozzle needle is now achieved because the relief valve 17 does not connect the pressure line 10 directly with a leakage line 19 but rather via a pressure chamber 20 of the injection nozzle 8. This pressure chamber 20 communicates with the leakage line 19 via a throttled connection. Thus upon diversion of fuel from the pressure line 10, a hydraulic overpressure occurs in the pressure chamber 20, which hydraulically reinforces a nozzle spring 21 in the closing process. The result is a combination of stroke- and pressure-controlled closure. The closing time is shortened. A blowback of combustion gases into the injection nozzle is prevented. The spring chamber of the nozzle spring 21 can also be used as the pressure chamber 20. The relief of the system after the injection is effected via the pressure chamber 20 and the leakage line 19.

Figure 2:
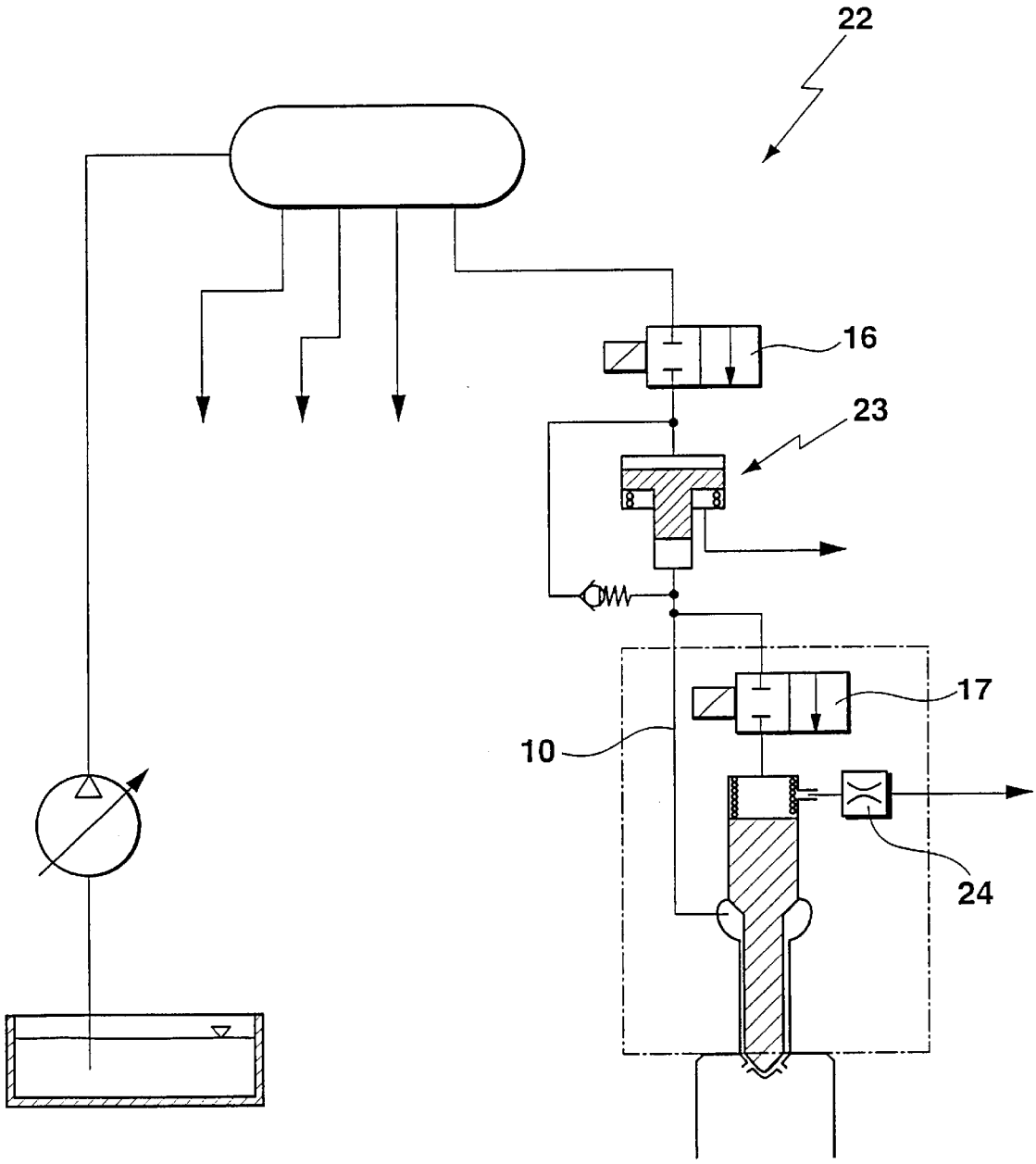
FIG. 2 schematically illustrates a second fuel injection system according to the teaching of the invention.

FIG. 2 shows the hydraulically reinforced closing process for a pressure-controlled fuel injection system 22, which additionally has a pressure booster 23. The use of the relief valve 17 in the pressure line 10 has an especially favorable effect here, because the pressure reduction on the high-pressure side of the pressure booster 23 takes place directly at the injection nozzle. To optimize the relief operation, a throttle 24, which limits the pressure drop, is additionally disposed at the outlet of the nozzle chamber. The refilling of the pressure booster is accomplished on the basis of the pressure decrease on the high-pressure side. After the closure of the metering valve 16, the pressure booster 23, with the pressure line 10 relieved, fills again because of the compression spring in the idle volume and returns to its outset position.

Figure 3:
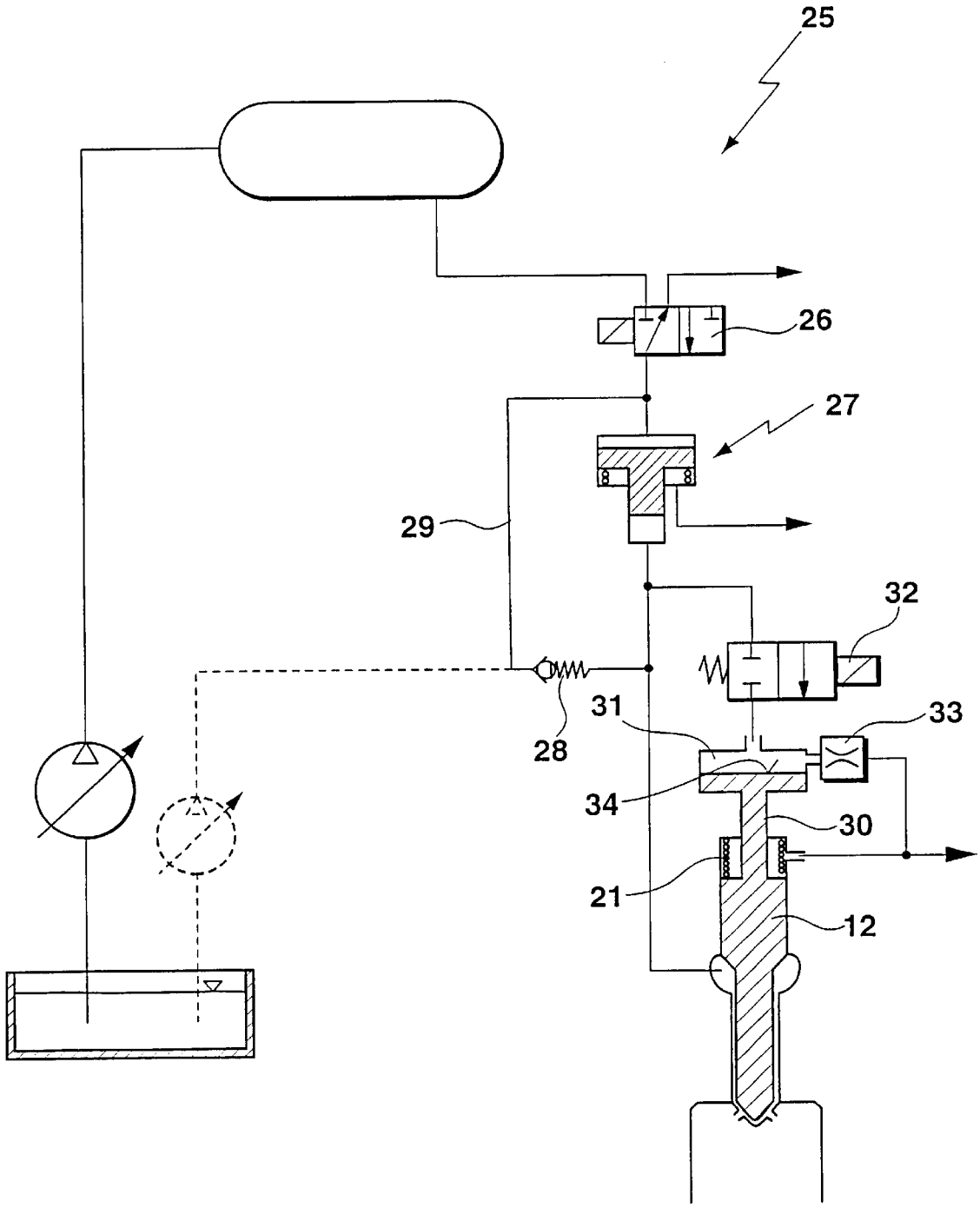
FIG. 3 schematically illustrates a third fuel injection system according to the teaching of the invention.

From FIG. 3, it can be seen that in a fuel injection system 25, a 3/2-way valve 26 is used as the metering valve. Once again, the closure of the nozzle needle 12 is effected with hydraulic reinforcement. The injection takes place under pressure control. For filling a pressure booster 27, a check valve 28 is provided, which can be connected either to a pressure line 29 or to the fuel pump (the latter indicated by dashed lines). To achieve a hydraulically reinforced closure of the nozzle needle 12, a closing piston 30, which defines a pressure chamber 31, is provided on the injection nozzle. The pressure chamber 31 can be subjected to pressure via a 2/2-way valve 32. Via a throttle 33, the pressure chamber 31 is pressure-relieved, with the valve 32 closed. A pressure face 34 is designed such that with the valve 32 open, a hydraulic force is generated, which forces a closure of the nozzle needle. The injection pressure in the nozzle chamber 11 is applied unchanged. By the closure of the valve 32, the pressure chamber 31 can be relieved again, and the nozzle needle 12 opens again. A postinjection at high pressure then takes place.

Figure 4:
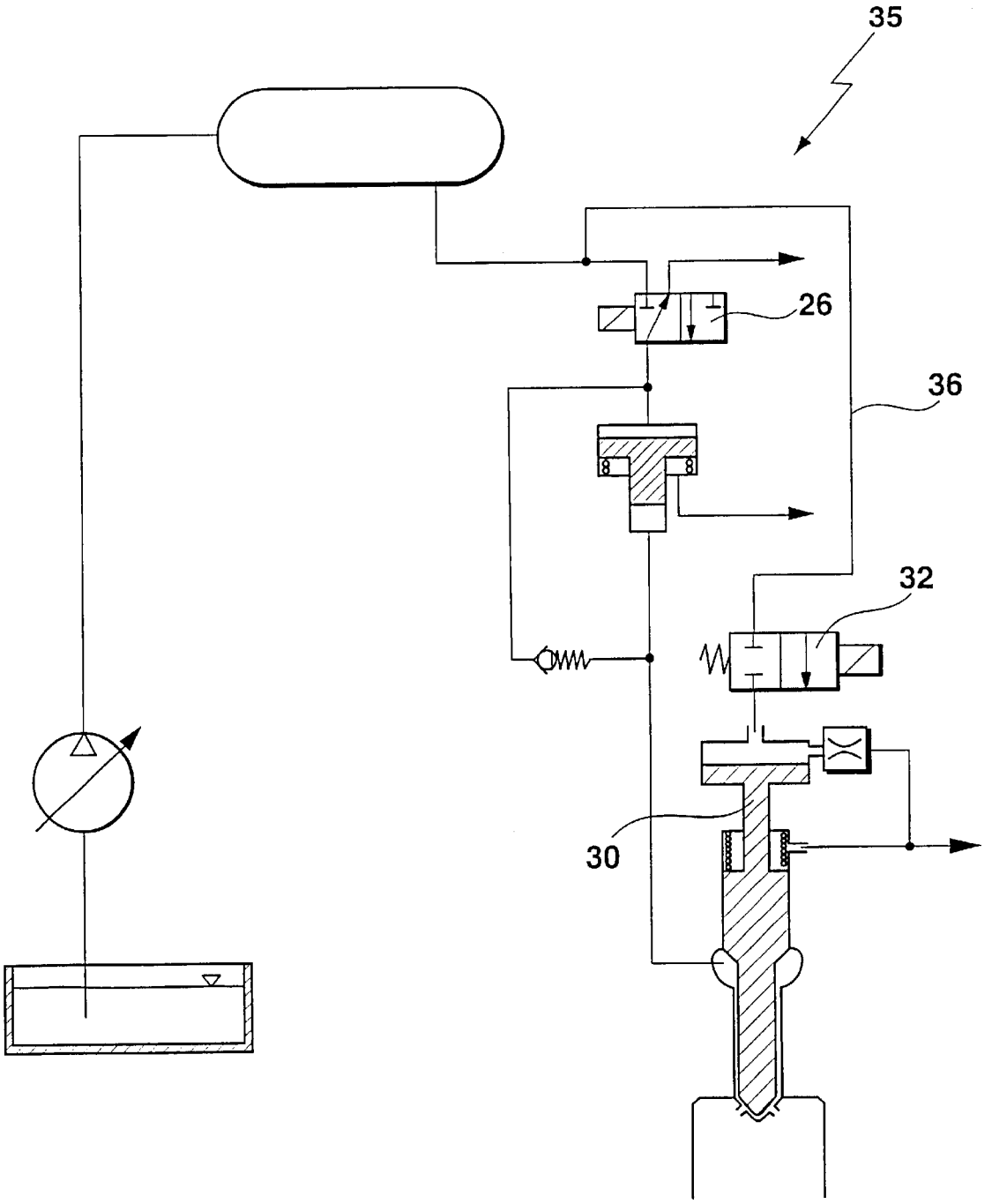
FIG. 4 schematically illustrates a fourth fuel injection system according to the teaching of the invention.

In FIG. 3, the elevated pressure from the high-pressure chamber of the pressure booster is used to close the nozzle needle 12. It is equally possible, given a suitable design of the pressure face 34, also to use the pressure prevailing in the pressure reservoir 6 to close the nozzle needle 12, as shown in FIG. 4. In this fuel injection system 35, a supply line 36 is provided between the valves 26 and 32. Additional leakage through the valve 32 is prevented.

Figure 5:
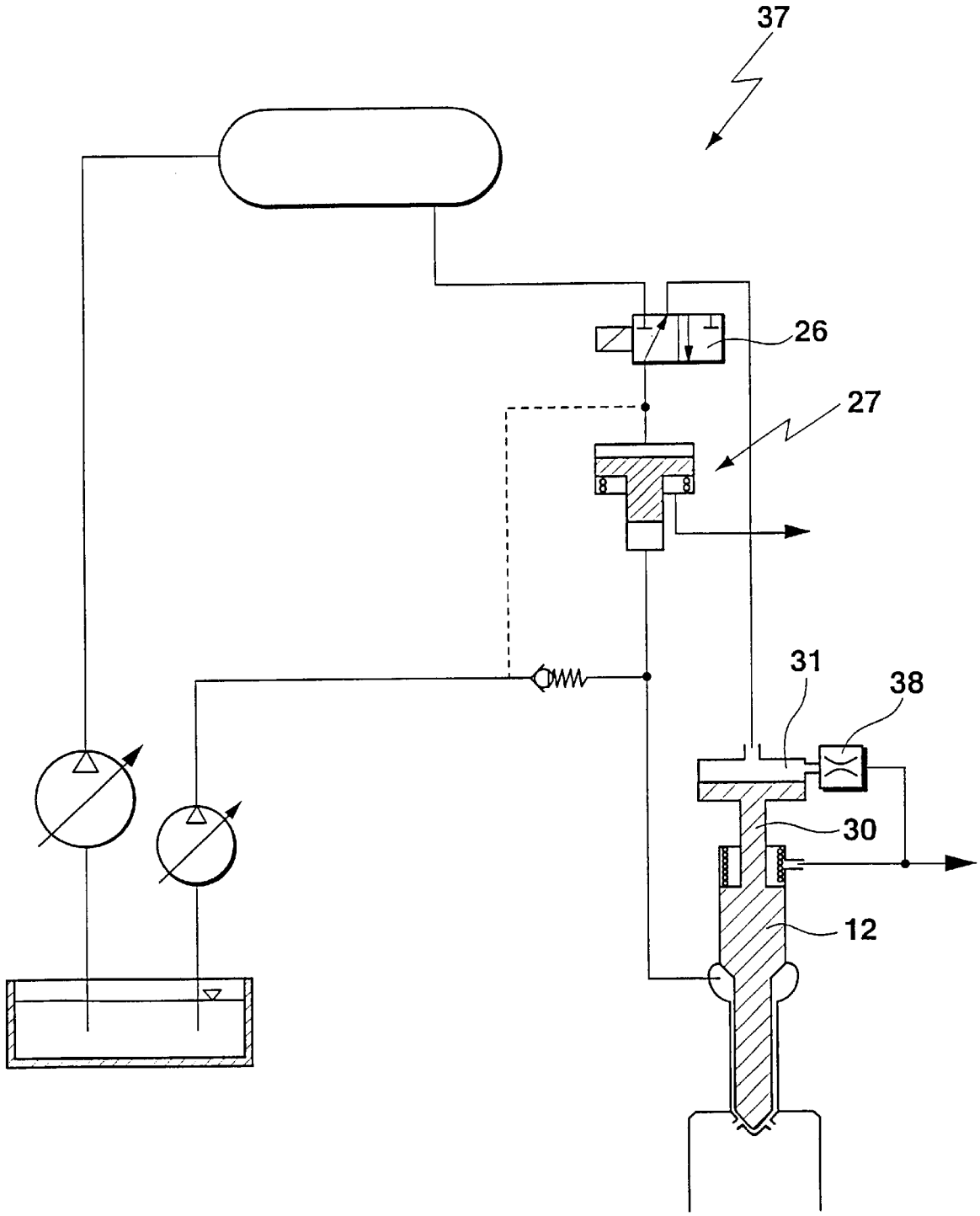
FIG. 5 schematically illustrates a fifth fuel injection system according to the teaching of the invention.

The exemplary embodiment of FIG. 5 avoids the disadvantage of using an additional valve 32, by using the diversion flow from the metering valve 26 to close the nozzle needle 12. FIG. 5 shows the fuel injection system 37, with control of the metering by means of the 3/2-way valve 26, and with an integrated, hydraulically reinforced closure of the nozzle needle 12 with the aid of the diversion flow. In this fuel injection system 37, the relief flow from the pressure booster 27 is carried through the valve 26 into the pressure chamber 31 at the end of injection. This subjects the closing piston 30 to pressure. A hydraulically reinforced closure of the nozzle needle 12 is forced to happen. A new injection can then be effected by re-triggering of the metering valve 26. A slow pressure reduction in the pressure booster and injection region can be achieved by means of a small flow cross section of a throttle 38. Thus given a suitable design, without an additional valve 32 (see FIG. 4), a fast closure of the nozzle needle 12 and a postinjection at high pressure can be attained. The overlap of the opening cross section and the relief cross section, which often occurs in a 3/2-way valve, is no disadvantage in this fuel injection system 37. A desired additional pressure buildup in the pressure chamber 31 is briefly achieved.

The foregoing relates to preferred exemplary embodiments of the invention, it being understood that other variants and embodiments thereof are possible within the spirit and scope of the invention, the latter being defined by the appended claims.

We claim:

1. A pressure-controlled fuel injection system (18; 22; 25; 35; 37), comprising a nozzle needle (12) which is subjected to pressure in the closing direction by a nozzle spring (21), in which for opening of the nozzle needle (12) a nozzle chamber is connectable via a pressure line (10) to a pressure reservoir (6), and a hydraulic device for reinforcing the closing performance of the nozzle needle (12), wherein the pressure line (10) includes a pressure booster (23).

2. The fuel injection system according to claim 1, wherein the pressure booster (23) is operated with fuel as the working medium.

3. A fuel injection system (18; 22; 25; 35; 37), comprising a nozzle needle (12) which is subjected to pressure in the closing direction by a nozzle spring (21), in which for opening of the nozzle needle (12) a nozzle chamber is connectable via a pressure line (10) to a pressure reservoir (6), and a hydraulic device for reinforcing the closing performance of the nozzle needle (12), wherein the pressure line (10) includes a pressure booster (23), and wherein further the pressure chamber (31) is connectable to the pressure reservoir (6) via a pressure line (36) that includes a valve (32).

4. The fuel injection system according to claim 2 wherein the pressure chamber (31) is connectable to the pressure reservoir (6) via a pressure line (36) that includes a valve (32).

5. A fuel injection system (18; 22; 25; 35; 37), comprising a nozzle needle (12) which is subjected to pressure in the closing direction by a nozzle spring (21), in which for opening of the nozzle needle (12) a nozzle chamber is connectable via a pressure line (10) to a pressure reservoir (6), and a hydraulic device for reinforcing the closing performance of the nozzle needle (12), wherein the pressure line (10) includes a pressure booster (23), further comprising a metering valve (26) operable to control the imposition of pressure on the pressure chamber (31) for performing the fuel injection.

6. The fuel injection system according to claim 2 further comprising a metering valve (26) operable to control the imposition of pressure on the pressure chamber (31) for performing the fuel injection.

7. The fuel injection system according to claim 1 further comprising a pressure chamber (20; 31), and a valve (17) operable to connect the pressure chamber (20;31) to the pressure line (10).

8. The fuel injection system according to claim 7 wherein the pressure chamber (31) is connectable to the pressure reservoir (6) via a pressure line (36) that includes a valve (32).

9. The fuel injection system according to claim 7 further comprising a metering valve (26) operable to control the imposition of pressure on the pressure chamber (31) for performing the fuel injection.

10. The fuel injection system according to claim 8 further comprising a metering valve (26) operable to control the imposition of pressure on the pressure chamber (31) for performing the fuel injection.

* * * * *